US005207540A

United States Patent [19]

Baldini

[11] Patent Number: 5,207,540

[45] Date of Patent: May 4, 1993

[54] APPARATUS FOR FORMING DIAMOND-SHAPED EDGES ON ORNAMENTAL CHAINS

[75] Inventor: Mariano Baldini, Arezzo, Italy

[73] Assignee: Uno A Erre Italia S.p.A., Arezzo

[21] Appl. No.: 852,679

[22] Filed: Mar. 17, 1992

[30] Foreign Application Priority Data

Mar. 28, 1991 [IT] Italy ..... FI91 A 000067

[51] Int. Cl.[5] ..... B23C 3/00

[52] U.S. Cl. ..... 409/163; 144/134 R; 144/150; 144/219; 144/253 F; 409/228

[58] Field of Search ..... 409/138, 145, 157, 163, 409/227, 228; 144/30, 134 B, 134 R, 218, 219, 253 F, 150

[56] References Cited

U.S. PATENT DOCUMENTS 2,612,914 10/1952 Reynolds ..... 144/253 F 3,377,896 4/1968 deCorta ..... 409/138

FOREIGN PATENT DOCUMENTS 3526950 8/1986 Fed. Rep. of Germany ..... 409/138

213405 10/1985 Japan ..... 409/138

*Primary Examiner*—Daniel W. Howell

*Attorney, Agent, or Firm*—Hopgood, Calimafde, Kalil, Blaustein & Judlowe

[57] ABSTRACT

The apparatus is used for forming a diamond shape on ornamental chains (C) of variable width, and comprises a support having a slide guide flange (1A) with an intermediate gap (3) for the space required for the diamond-shaping tool (5), a shoe for lateral pressure against the support and, to serve as guide means acting along the edge (B1) of the chain opposite the edge (B) to be given a diamond shape, two pressers (14) acting independently on said edge (B1) adjacently to said gap (3).

7 Claims, 2 Drawing Sheets

APPARATUS FOR FORMING DIAMOND-SHAPED EDGES ON ORNAMENTAL CHAINS

The invention relates to an apparatus for forming diamond-shaped edges on ornamental chains, generally of precious metals, or for costume jewelry. Apparatuses of this type comprise a support having a flange at right angles or the equivalent, which constitutes a slide guide with an intermediate gap for the space required for the rotary diamond-shaping tool, a shoe for lateral pressure against the support, and guide means acting along the edge of the chain opposite the edge which is to be given a diamond shape. The aim of the invention is to permit the machining of chains having a variable width between the edges, and for this purpose said guide means, acting along the edge opposite the edge to be machined, comprise two pressers acting independently on the edge adjacently to said gap zone.

The two pressers are stressed with elastic thrusts, which may be identically or independently adjustable. The two elastic pressers may be stressed by a single elastic member, and in particular the two pressers may be formed by respective oscillating right-angled members or the like which are stressed by a single elastic member reacting between them.

As an alternative, the two pressers may be formed by two projections on a single oscillating member subjected to the thrust of an elastic thrust actuator.

As another alternative, the two pressers may be subjected to the thrust of respective actuators of the mechanical, pneumatic, electrical or similar type.

The operative surface of the two pressers may be slightly convex.

With the arrangement described it is possible for chains having a variable width gradually increasing or decreasing to be moved forward and held correctly positioned for the diamond shaping, without any practical difference in treatment of the edge which is to be given a diamond shaped, that is the edge opposite that on which the pressers act.

Figure 1:
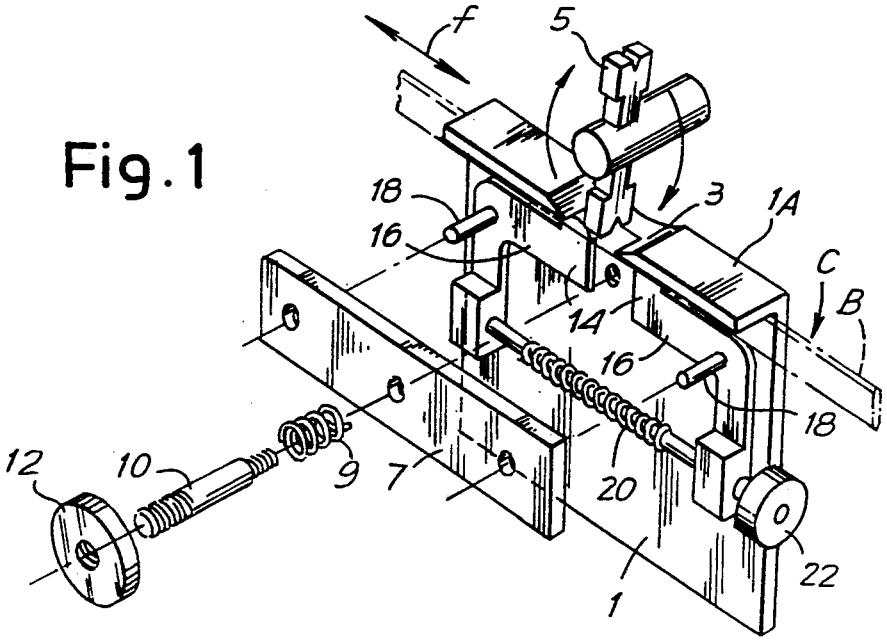
Figure 2:
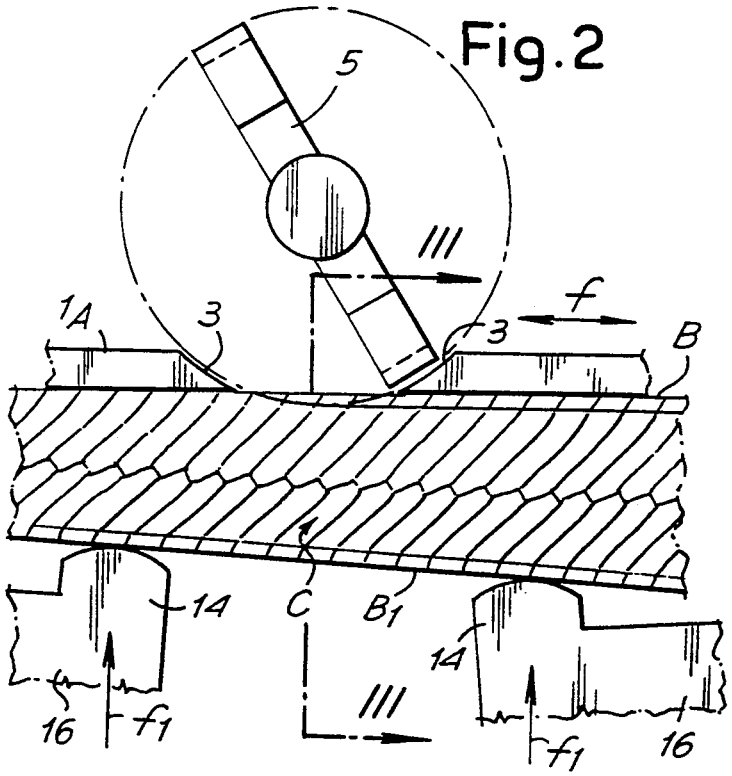
Figure 3:
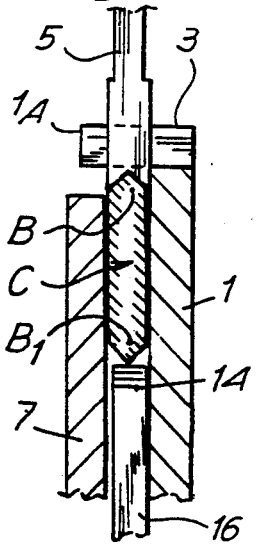
Figure 4:
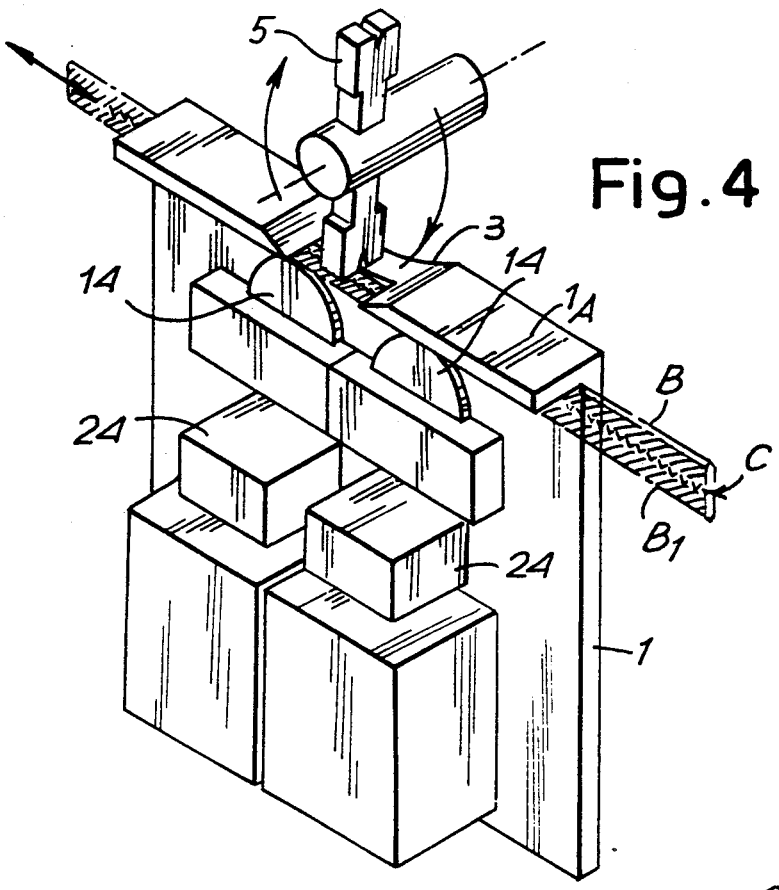
Figure 5:
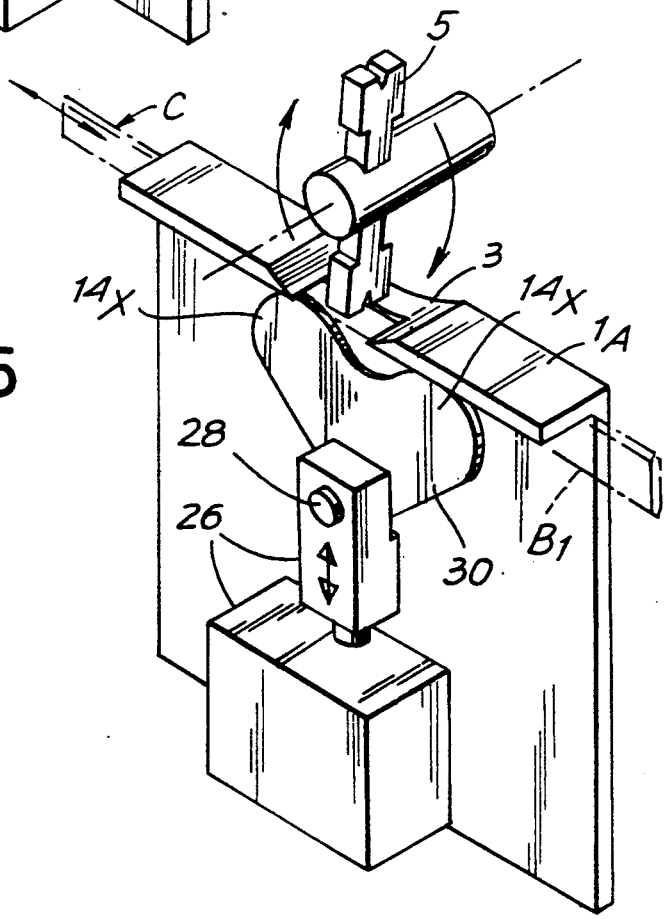

The invention will be better understood on study of the description and the accompanying drawings, which illustrates a practical, non-limitative example of said invention and in which:

FIG. 1 is an overall view in perspective of one possible solution comprising a single elastic member acting on both the pressers, FIG. 2 is a front view of a detail on a larger scale, showing the working zone of the apparatus, FIG. 3 is a local transverse cross-section taken along the line III—III in FIG. 2, and FIGS. 4 and 5 show in perspective two constructional variants of the preceding figures.

As illustrated in the accompanying drawing, 1 designates a support which is provided with a portion 1A extending at right angles and suitable for forming a guide flange for the chain C, which must be caused to slide in the direction of the double arrow f in order to effect the diamond-shaping. The portion 1A extending at right angles has a gap at a zone 3, which is the operative zone for the diamond-shaping tool 5 mounted rotatably on an axis at right angles to the plane in which lies the chain whose edges have to be machined in succession. The cutting edges of the diamond-shaping tool 5 intersect the profile of the guide flange having a gap in the zone 3, so as to act on the edge B of the ornamental chain C being machined. The chain C is pressed laterally by a shoe 7 against the side of the support 1 in such a manner as to cause it to bear uniformly against said support by means of elastic stress, which can for example be obtained with the aid of a spring 9 acting on the shoe 7 and guided by a rod 10, said spring being adjusted via of a screw means 12 which engages on said rod 10 for adjusting the thrust of the compression spring 9 against the shoe 7.

The edge B1 of the chain C opposite the edge B which is to be machined, is stressed by two pressers 14, which have a slightly convex operative profile suitable for acting on said edge B1 opposite said edge B to be machined, said pressers 14 acting on opposite sides of the gap 3 in the stepped portion 1A of the support 1. The exact position of the pressers 14 relative to the gap 3 may also be adjustable and may depend on the characteristics of the chain to be machined, particularly the rigidity characteristics of the main plane of the chain, which may be a beaten chain or other equivalent. The shoe 7 does not act on the pressers 14, since their thickness is less than that of the chain C being machined.

In the embodiment shown in FIGS. 1 to 3 the pressers 14 are formed by projections on two right-angled members 16 pivotably connected on respective pins 18 to the support 1 and stressed elastically to press the pressers 14 against the edge B1 in the direction of the arrow f1 in FIG. 2 through the action of a single spring 20 acting by tension on the arms of the right-angled members 16 opposite those provided with the projections forming the pressers 14. The tension of the spring 20 can be adjusted with the aid of a knob 22 or other equivalent. It is clear that whatever the width of the chain in the zone being machined at a given moment, that is to say in the zone of the gap 3 and in the portion between the two pressers 14, said chain will be correctly guided, since the pressers 14 have limited movability in the plane in which the chain lies during its sliding in the direction of the double arrow f. The action of the diamond-shaping tool 5, and in particular the direction of rotation of said tool, is immaterial in relation to the direction of sliding of the chain, which is moved forward for the machining of its edge B.

In the variant embodiment shown in FIG. 4 the arrangement is equivalent to that in the solution previously described, with the sole modification that the two pressers 14 are actuated by respective actuators 24 instead of by the system previously described, that is to say by the spring 20. Each of these actuators may be of the mechanical, pneumatic, electric or other type.

In the further variant, shown in FIG. 5, a single actuator 26 is provided and has pivotably connected to it at 28 an oscillating member 30, which forms two projections constituting the pressers 14, which are designated 14X; these two projections also act on the edge B1 opposite the edge B being machined, acting on different sides of the zone being machined at a given moment by the tool 5.

It is understood that the drawing illustrates only an example, which is given solely as a practical demonstration of the invention, and that the latter may vary in form and arrangement without thereby departing from the scope of the concept underlying said invention. Any reference numerals given in the accompanying claims serve to facilitate the reading of the claims by reference to the description and drawing, and do not limit the scope of the protection given by said claims.

I claim:

1. An apparatus for forming a diamond shape on ornamental chains, comprising a support having a slide guide flange with an intermediate gap for the space required for the diamond-shaping tool, a shoe for lateral pressure against the support, and guide means acting along the edge opposite the edge which is to be given a diamond-shape, wherein, for the machining of ornamental chains having a variable width between the edges, said guide means acting along the edge opposite the edge to be machined comprise two pressers acting independently on said edge adjacently to said gap zone.

2. The apparatus as claimed in the preceding claim, wherein the two pressers are stressed by an adjustable elastic thrust.

3. The apparatus as claimed in claim 1, wherein the two elastic pressers are stressed by a single elastic member.

4. The apparatus as claimed in claim 3, wherein the two pressers are formed by respective oscillating right angled members which are stressed by a single elastic member reacting between them.

5. The apparatus as claimed in claim 3, wherein the two pressers are formed by two projections on a single oscillating member subjected to the thrust of an actuator.

6. The apparatus as claimed in claim 1, wherein the two pressers are subjected to the thrust of respective actuators of the mechanical, pneumatic, or electrical type.

7. The apparatus as claimed in claim 1, wherein the pressers have a slightly convex operative profile.

* * * * *